US007491112B2

(12) United States Patent
Chen

(10) Patent No.: US 7,491,112 B2
(45) Date of Patent: Feb. 17, 2009

(54) MOBILE ROBOTIC DEVICE CAPABLE OF COLLISION DETECTION

(75) Inventor: Hung-Kai Chen, Taichung County (TW)

(73) Assignee: E-Supply International Co., Ltd., Taichung (TW)

( * ) Notice: Subject to any disclaimer, the term of this patent is extended or adjusted under 35 U.S.C. 154(b) by 507 days.

(21) Appl. No.: 11/411,117

(22) Filed: Apr. 26, 2006

(65) Prior Publication Data

US 2007/0167109 A1 Jul. 19, 2007

(30) Foreign Application Priority Data

Dec. 27, 2005 (TW) ..... 94222771 U

(51) Int. Cl.
*A63H 17/26* (2006.01)
*A63H 30/02* (2006.01)

(52) U.S. Cl. ..... 446/469; 446/454; 446/448

(58) Field of Classification Search ..... 446/466, 446/469, 454–456, 448–449, 451, 175; 463/58; 901/1, 19, 25; 700/245; 180/252–267; 104/60
See application file for complete search history.

(56) References Cited

U.S. PATENT DOCUMENTS

| | | | | |
|---|---|---|---|---|
| 5,785,576 | A * | 7/1998 | Belton | 446/456 |
| 6,840,839 | B2 * | 1/2005 | Rehkemper et al. | 446/454 |
| 7,335,084 | B2 * | 2/2008 | Sato | 446/469 |
| 2006/0128268 | A1 * | 6/2006 | Laurienzo et al. | 446/454 |

* cited by examiner

*Primary Examiner*—Dmitry Suhol
*Assistant Examiner*—Alex F R Rada, II
(74) *Attorney, Agent, or Firm*—Bacon & Thomas, PLLC

(57) ABSTRACT

A mobile robotic device capable of collision detection includes a base frame, two connecting rods pivotably mounted to the base frame for contact with the switches, two gearboxes slidably mounted at bilateral sides of the base frame respectively, two driving mechanisms connected with the gearboxes, two switches mounted to the base frame for generating signals, two springy members connected with the base frame and the connecting rods for keeping the gearboxes rebounding backward, two wheels mounted to the two gearboxes respectively, and a control system mounted to the base frame for receiving the signals from the switches and driving the driving mechanisms and thus driving clockwise or counterclockwise rotation of the wheels.

5 Claims, 5 Drawing Sheets

MOBILE ROBOTIC DEVICE CAPABLE OF COLLISION DETECTION

BACKGROUND OF THE INVENTION

1. Field of the Invention

The present invention relates generally to mechanisms capable of collision detection, and more particularly, to a mobile robotic device capable of collision detection.

2. Description of the Related Art

A conventional mechanism capable of collision detection is mounted to a mobile robotic device, having a photo-breaker, a shading piece, a driving mechanism, and a bumper. The photo-breaker is mounted at a front side of the robotic device for controlling the driving mechanism. The bumper is mounted in front of the photo-breaker, having a shading piece detachably placed to the photo-breaker. While colliding with a barrier, the bumper drives the shading piece to mask the light source of the photo-breaker, further controlling the driving mechanism.

However, the above-mentioned conventional mechanism capable of collision detection has two drawbacks for improvement. First, the bumper is mounted outside the robotic device; when the bumper malfunctions, the bumper will fail to drive the shading piece to mask the photo-breaker and thus fail to drive the driving mechanism. Second, because the area that the bumper collides with the carrier is limited, the bumper will fail to detect the collision if the barrier is not located in the area.

SUMMARY OF THE INVENTION

The primary objective of the present invention is to provide a mobile robotic device capable of collision detection, which is not subject to malfunction resulted from collision.

The secondary objective of the present invention is to provide a mobile robotic device capable of collision detection, which works whenever colliding with a barrier at any angle and any direction.

The foregoing objectives of the present invention are attained by the mobile robotic device capable of collision detection, which is composed of a base frame, two connecting rods pivotably mounted to the base frame for contact with the switches, two gearboxes slidably mounted at bilateral sides of the base frame respectively, two driving mechanisms connected with the gearboxes, two switches mounted to the base frame for generating signals, two springy members connected with the base frame and the connecting rods for keeping the gearboxes rebounding backward, two wheels mounted to the two gearboxes respectively, and a control system mounted to the base frame for receiving the signals from the switches and driving the driving mechanisms and thus driving clockwise or counterclockwise rotation of the wheels.

DETAILED DESCRIPTION OF PREFERRED EMBODIMENTS

Figure 1:
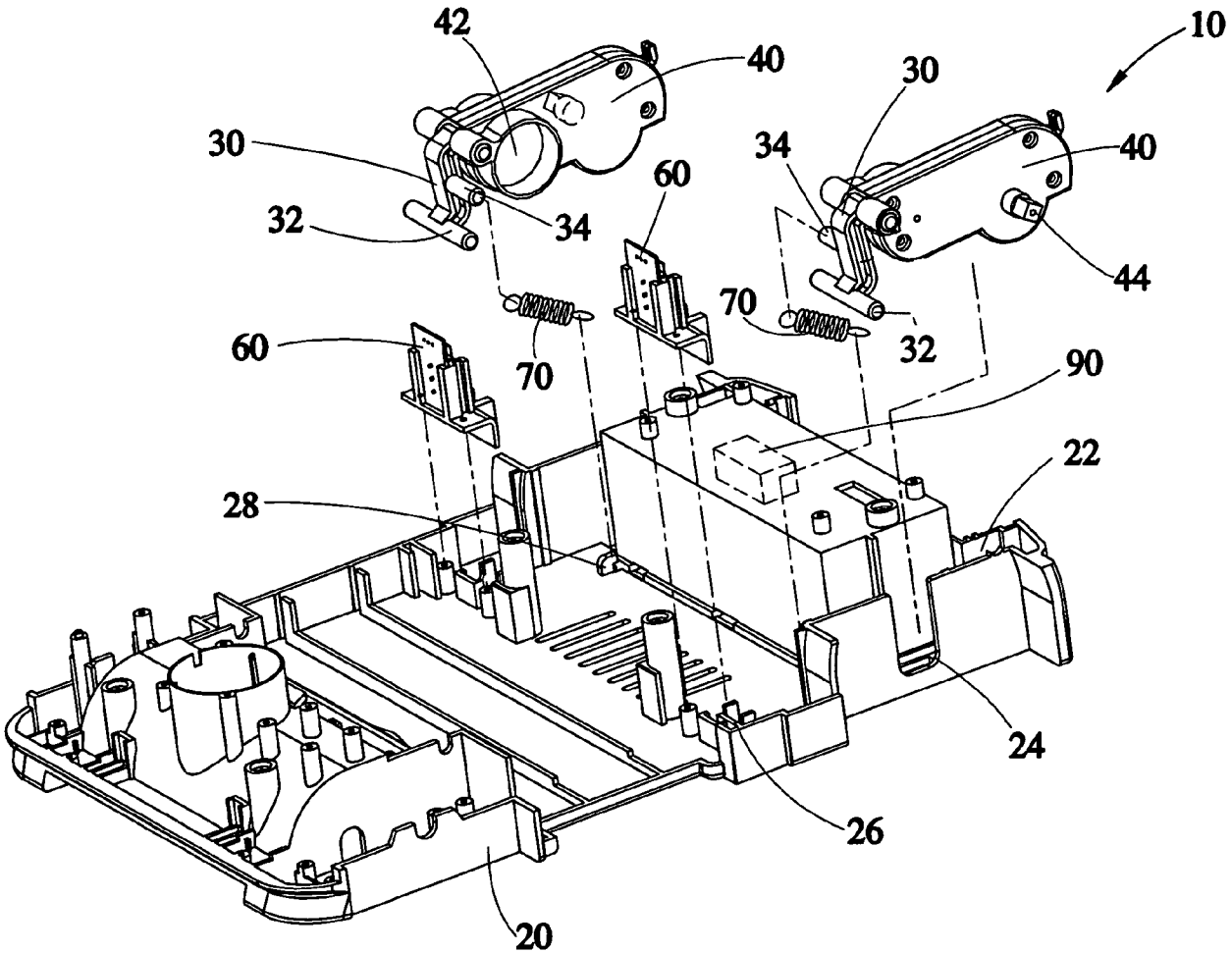
FIG. 1 is an exploded view of a first preferred embodiment of the present invention.
Figure 2:
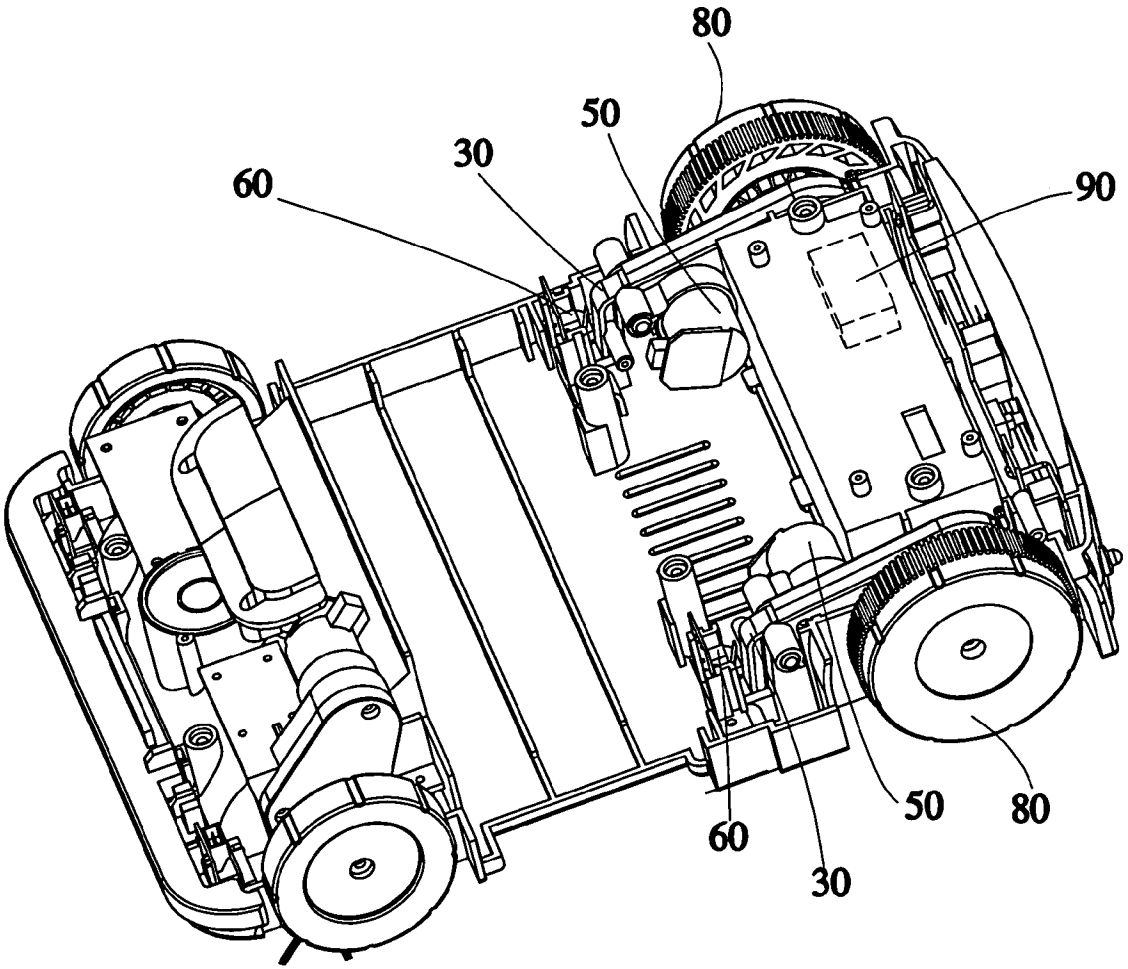
FIG. 2 is a perspective view of the first preferred embodiment of the present invention.
Figure 3:
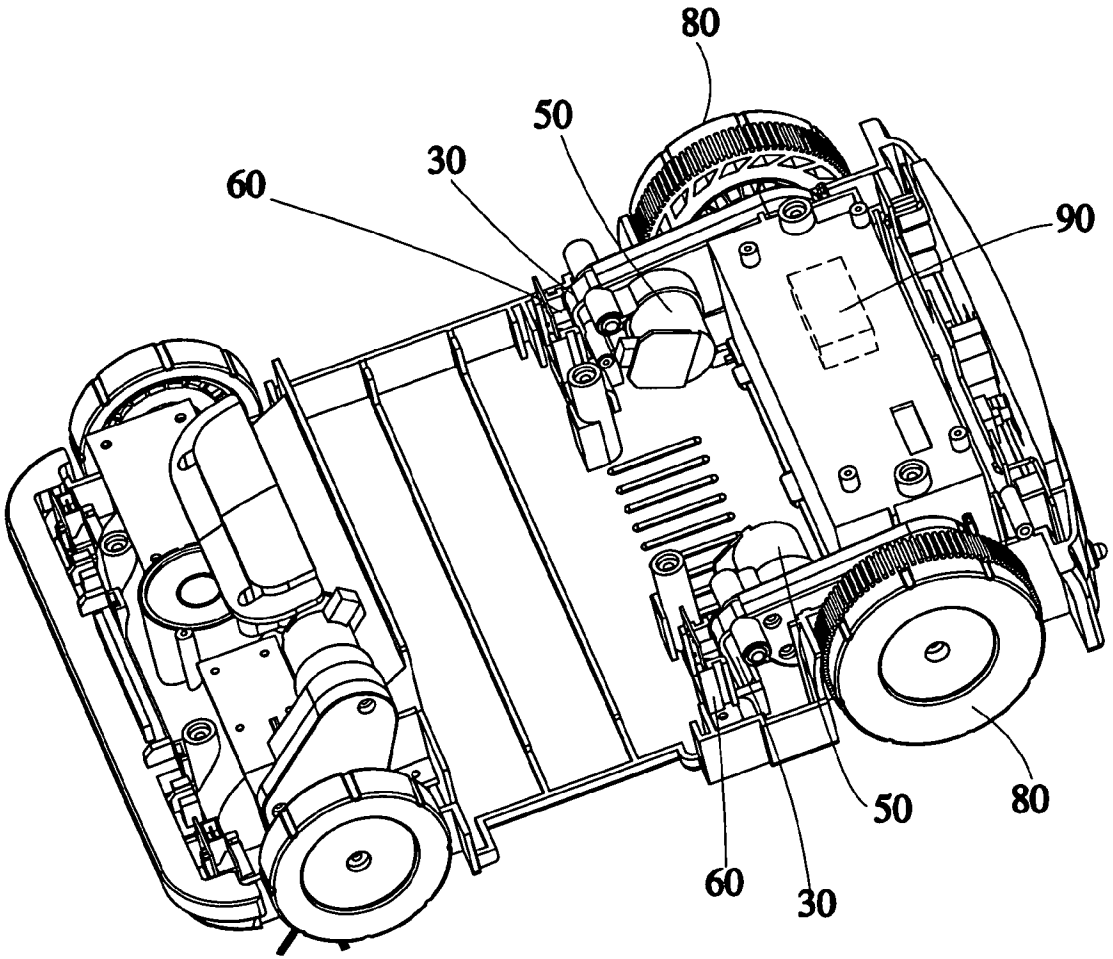
FIG. 3 is another perspective view of the first preferred embodiment of the present invention at work.
Figure 4:
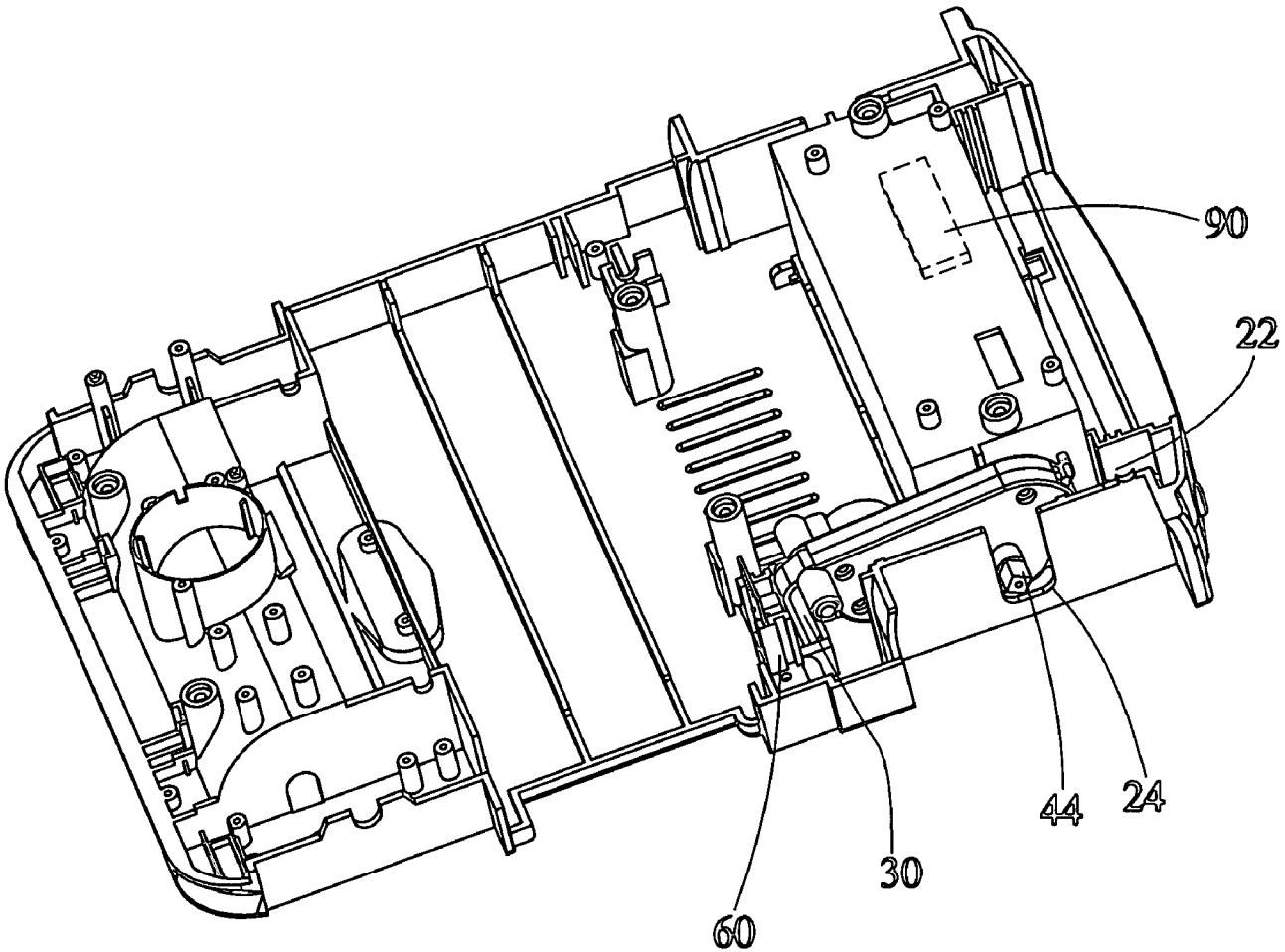
FIG. 4 is a perspective view of a part of the first preferred embodiment of the present invention.

Referring to FIGS. 1-4, a mobile robotic device 10 capable of collision detection is composed of a base frame 20, two connecting rods 30, two gearboxes 40, two driving mechanisms 50, two switches 60, two springy members 70, two wheels 80, and a control system 90.

The base frame 20 includes two guide grooves 22 formed at bilateral sides thereof respectively, two openings 24 formed at outer sidewalls of the two guide grooves 22 respectively, two pivot cavities 26 formed thereon for connection with the connecting rods 30 respectively, and two hook portions 28 formed thereon for connection with the springy members 70 respectively.

Each of the connecting rods 30 is located at a front end of the guide groove 22, including a pivot pin 32 pivotably mounted to the pivot cavity 26 for forward and backward pivoting movement, and a connecting portion 34 connected with the springy member 70.

Each of the gearboxes 40 is received in the guide groove 22, having a front end connected with the connecting rod 30 for forward and backward movement driven by an external force and then driving the connecting rod 30 to pivot. Each of the gear boxes 40 includes a power input portion 42 and a power output shaft 44 protruding outward out of the opening 24. Each of the openings 24 is wider than the power output shaft 44 to allow the power output shaft 44 to move forward and backward.

Each of the driving mechanisms 50 is connected with the power input portion 42 of the gear box 40 for providing driving power.

Each of the switches 60 is a microswitch mounted on the base frame 20 and located ahead of the connecting rod 30, for generating signals. While the gear boxes 40 are moved forward and backward, the connecting rods 30 touch and activate the microswitches respectively.

Each of the springy members 70 includes two ends mounted to the hook portion 28 and the connecting rod 30 respectively, for providing resilience keeping each of the gearboxes 40 rebounding backward.

The wheels 80 are mounted to the two power output shafts 44 respectively.

The control system 90 is connected with the two driving mechanisms 50 and the two switches 60 for receiving the signals from the switches 60 and further changing the driving status of the two driving mechanisms 50.

In operation, while the mobile robotic device 10 capable of collision detection moves forward on the ground or plane, each of the power output shafts 33 is located at a rear side of the opening 24. While the robotic device 10 collides with a barrier, the base frame 20 stops moving forward, but the driving mechanisms 50 keep driving rotation of the wheels 80 to drive slidable movement of the power output shafts 44 in the openings 24. In the meantime, the gearboxes 40 are driven by the wheels 80 to slidably move in the openings 24 and the connecting rods 30 are driven by the gearboxes 40 to pivot forward to further touch and activate the switches 60 respectively. Then, the switches 60 transmits the signals to the control system 90 and the control system 90 controls the driving mechanisms 50 to stop driving or to reverse rotation of the wheels 80.

Figure 5:
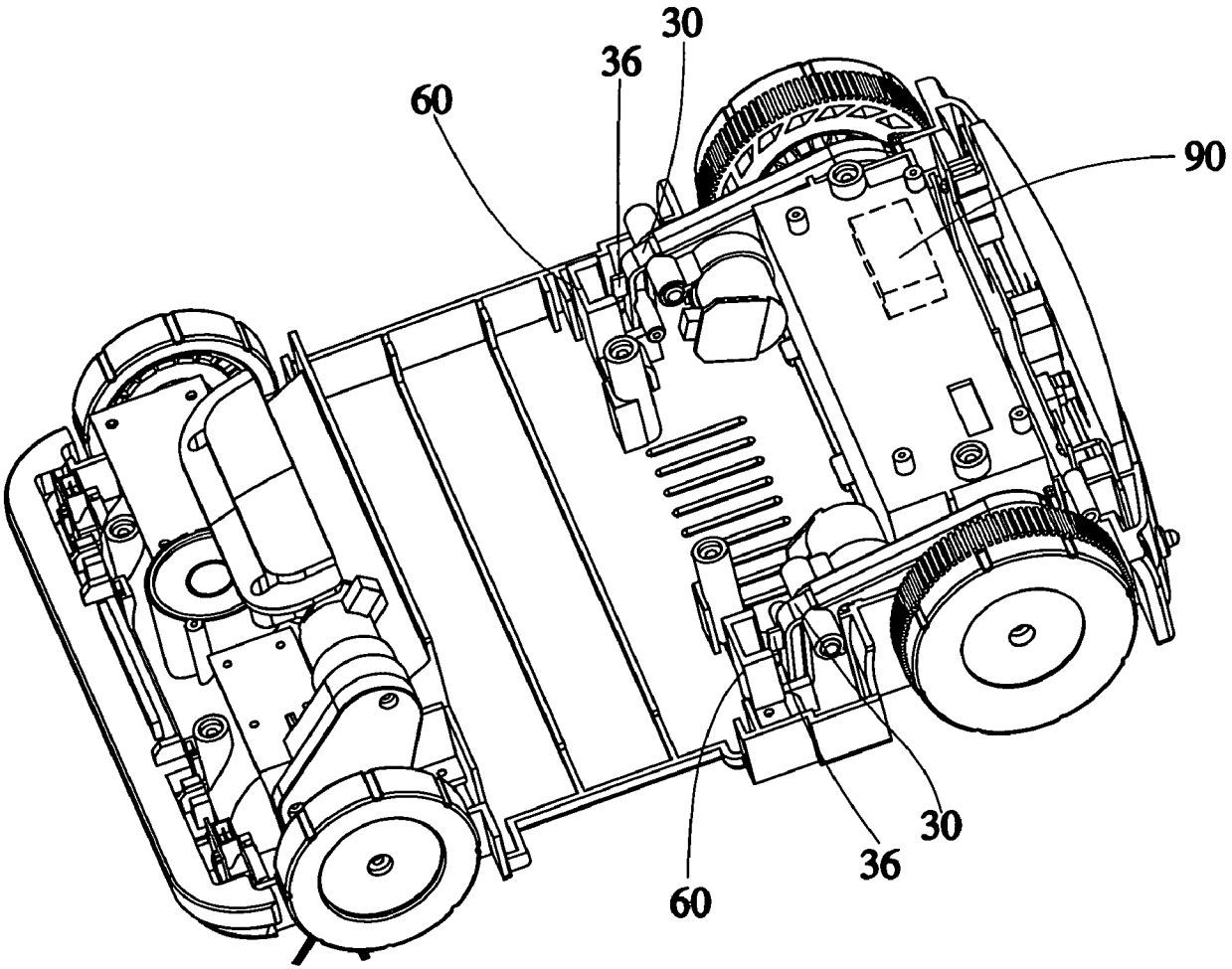
FIG. 5 is a perspective view of a second preferred embodiment of the present invention.

Referring to FIG. 5, a mobile robotic device capable of collision detection, constructed according to a second preferred embodiment of the present invention, is similar to the first embodiment, having difference as follows. Each of the switches 60 is a photo-breaker 36. Each of the connecting rods 30 includes a shading piece 36 which can be driven by the connecting rod 30 to mask the light source of the photo-breaker 60 to further activate the switch 60.

In conclusion, because the elements capable of detecting collision of the present invention are mounted inside the mobile robotic device, they are not subject to damage or malfunction while the robotic device collides with the barrier. Further, because the elements of the present invention indirectly detects the collision by means of the base frame, while the robotic device collides with the barrier at whichever angles and directions, the elements still function well.

What is claimed is:

1. A mobile robotic device capable of collision detection, comprising:

a base frame having two guide grooves and two openings, said guide grooves being formed at bilateral sides of said base frame respectively, each of said openings being formed at an outer sidewall of each of said guide grooves;

two connecting rods each located at a front end of each of said guide grooves and each having an end pivotably mounted to said base frame for forward and backward pivoting movement;

two gearboxes received in said two guide grooves respectively and each having a front end connected with the other end of each of said connecting rods for forward and backward movement externally forced to drive the pivoting movement of said connecting rods, each of said two gearboxes having a power input portions and a power output shaft, said power output shafts protruding outward out of said openings, wherein each of said opening is wider than said power output shaft to allow forward and backward motion of said power output shafts in said openings respectively;

two driving mechanisms connected with said power input portions of said gearboxes respectively for providing driving power;

two switches mounted to said base frame and located ahead of said two connecting rods for generating and transmitting signals while said two gearboxes are moved forward and backward to drive said two connecting rods respectively to activate said two switches respectively;

two springy members each having two ends mounted to said base frame and connected with said connecting rod respectively for generating resilience keeping said gearboxes rebounding backward;

two wheels connected with said two power output shafts respectively; and a control system connected with said two driving mechanisms and said two switches for controlling said two driving mechanisms and receiving the signals from said switches and further changing driving status of said two driving mechanisms.

2. The mobile robotic device as defined in claim 1, wherein said base frame further comprises two pivot cavities; each of said connecting rods further comprises a pivot pin pivotably connected with each of said pivot cavities of said base frame.

3. The mobile robotic device as defined in claim 1, wherein said base frame further comprises two hook portions each connected with an end of said springy member; each of said connecting rods further comprises a connecting portion connected with the other end of said springy member.

4. The mobile robotic device as defined in claim 1, wherein each of said switches is a microswitch for transmitting the signals to said control system.

5. The mobile robotic device as defined in claim 1, wherein each of said switches is a photo-breaker; each of said connecting rods further comprises a shading piece for masking a light source of said photo-breaker to activate said photo-breaker while said connecting rods pivot.

* * * * *